US006241601B1

(12) United States Patent
Han et al.

(10) Patent No.: US 6,241,601 B1
(45) Date of Patent: Jun. 5, 2001

(54) HIGH EFFICIENCY AIR MIXER USING JET STREAMS

(75) Inventors: Ming Hui Han, Mississauga; Werner Richarz, Thornhill, both of (CA)

(73) Assignee: M & I Heat Transfer Products Ltd., Mississauga (CA)

( * ) Notice: Subject to any disclaimer, the term of this patent is extended or adjusted under 35 U.S.C. 154(b) by 0 days.

(21) Appl. No.: 09/351,881

(22) Filed: Jul. 13, 1999

(Under 37 CFR 1.47)

(51) Int. Cl.[7] ..... F24F 3/052
(52) U.S. Cl. ..... 454/268; 454/267
(58) Field of Search ..... 454/261, 264, 454/265, 266, 267, 268, 269

(56) References Cited

U.S. PATENT DOCUMENTS

| | | | | |
|---|---|---|---|---|
| 1,395,938 | | 11/1921 | Barducci . | |
| 1,753,156 | * | 4/1930 | Otis | 454/267 X |
| 3,318,225 | * | 5/1967 | May | 454/267 |
| 3,386,366 | * | 6/1968 | Economides et al. | 454/268 |
| 3,405,758 | | 10/1968 | Walker et al. | 165/16 |
| 3,911,804 | | 10/1975 | Tao | 165/19 |
| 4,078,576 | | 3/1978 | Punch et al. | 137/604 |
| 4,150,817 | | 4/1979 | Regelin et al. | 266/139 |
| 4,352,321 | | 10/1982 | Fukui et al. | 98/2.11 |
| 4,605,160 | * | 8/1986 | Day | 454/267 X |
| 4,793,247 | | 12/1988 | Verweij | 366/336 |
| 5,368,521 | | 11/1994 | Koenig | 454/261 |
| 5,463,967 | | 11/1995 | Gielow et al. | 454/261 |

FOREIGN PATENT DOCUMENTS

| | | |
|---|---|---|
| 2844 046 | 4/1980 | (DE) . |
| 688 786 | 9/1979 | (SU) . |
| WO 89/03006 | 4/1989 | (WO) . |

* cited by examiner

*Primary Examiner*—Harold Joyce
(74) *Attorney, Agent, or Firm*—Baker & Daniels

(57) ABSTRACT

A mixer for first and second fluids, e.g. fresh air and return air respectively, has an outlet for the first fluid which is contiguous to outlet for the second fluid. A first flap is able to move from a position wherein the fresh air outlet is closed to a position wherein the fresh air outlet is open. A second flap is able to move from a position wherein the return air outlet is closed to a position wherein the return air outlet is open. The first and second flaps are connected to move in unison from a position wherein the fresh air outlet is open and the return air outlet is closed to a position wherein the fresh air outlet is closed and the return air outlet is open. Preferably, there is a plurality of alternating fresh air and return air outlets, and the first and second flaps are fixedly joined substantially at right angles to one another.

19 Claims, 4 Drawing Sheets

HIGH EFFICIENCY AIR MIXER USING JET STREAMS

FIELD OF THE INVENTION

The present invention relates to a mixer for mixing separate fluid streams entering the mixer. This invention relates to a high efficiency air mixer for mixing fresh air, i.e. outside air, and recirculated air (sometimes referred to herein as return air) in an air handling system designed for installation in a large building or other structure.

BACKGROUND TO THE INVENTION

Mixers for fluids, e.g. gases, are known. Air mixers with air flow controlling means are known. For example, U.S. Pat. No. 3,405,758 to Walker et al., which issued Oct. 15, 1968, discloses mixing fresh air and recirculating air in a mixing chamber. The two air flows are controlled by two dampers, which operate such that when one damper opens the other damper closes. U.S. Pat. No. 4,352,321 to Fukui et al. which issued Oct. 5, 1982, discloses an automobile air conditioning system in which outside air and recirculated air may be directed into the automobile by moving a simple gate across openings from side by side outside and recirculating air ducts. PCT application FI88/00151 to C. Palander, published on Apr. 6, 1989 under WO89/03006, discloses an air conditioning apparatus with a mixing chamber for cold and warm air. It has a gate for adjusting the relative amounts of cold air or warm air passing through the air inlets. U.S. Pat. No. 5,368,521 to R. P. Koenig, which issued Nov. 29, 1994 discloses a fluid distributor for stratified mixing of air streams. None of these mixers are particularly efficient at mixing the two air streams. The present invention is directed to overcoming the deficiencies of prior systems.

The terms "comprising/comprises" when used in this specification are taken to specify the presence of the stated features, integers, steps or components but do not preclude the presence or addition of one or more other features, integers, steps, components or groups thereof.

SUMMARY OF THE INVENTION

According to the present invention, a mixer for first and second fluids comprises a plurality of first outlets for the first fluid and a plurality of second outlets for the second fluid with the first outlets alternating with the second outlets and each first outlet being contiguous with a respective one of the second outlets. The mixer has a first flap for each of the first outlets, each first flap being pivotable from one position wherein its respective first outlet is closed, through intermediate positions, to another position wherein its respective first outlet is open. There is also a second flap for each of the second outlets, each second flap being pivotable from an initial position wherein its respective second outlet is closed, through intermediate positions, to a further position wherein its respective second outlet is open. Each first flap is paired with one of the second flaps and is rigidly connected thereto so that each pair of first and second flaps moves in unison and in the same direction of rotation. During use of the mixer, all of the first and second flaps are pivotable in unison from the another position of the first flaps and the initial position of the second flaps to the one position of the first flaps and the further position of the second flaps. The first and second flaps of each pair are so arranged relative to one another that in the intermediate positions, the first and second fluids, upon exiting from the respective outlets, are diverted towards one another by the first and second flaps.

In another embodiment, the first fluid outlet has a substantially smaller cross-sectional area than that of the second fluid outlet.

In yet another embodiment, the first and second fluid outlets are rectangular in cross-section.

In a further embodiment, the first and second fluid outlets are rectangular in cross-section having heights and widths, and have heights H1 and H2 respectively, the ratio of H1 to H2 being from 1:4 to 3:4, said heights being smaller than said widths.

In yet a further embodiment, the mixer is for use with gases, and the first fluid is fresh air and the second fluid is return air.

In another embodiment, the first flap of a first pair of outlets consisting of a first outlet and a second outlet, and the second flap of a contiguous second pair of outlets consisting of a first outlet and a second outlet, are fixedly joined to one another and are rotatable about a common axis at the juncture of adjacent first and second outlets.

In yet another embodiment, each joined first and second flaps are substantially at right angles to one another and are pivotable about an axis which is adjacent to a juncture of adjacent first and second of outlets.

In a further embodiment, the mixer has a fresh air inlet connected to the first outlet and a return air inlet connected to the second outlet.

In another embodiment, the fresh air inlet is at a back of the mixer, the return air outlet is at a side of the mixer and the first and second outlets are at a front of the mixer.

In yet another embodiment, there is at least one perforated diffuser in a passageway from the return air inlet and the second outlet for distributing the return air across the width of the second outlet.

In another embodiment, the percentage of the area of perforations within a unit area of the second outlet varies across the width of the second outlet.

In yet another embodiment, the percentage of the area of perforations within a unit area of the second outlet gradually increases across the width of the second outlet.

In another embodiment, the mixer is part of an apparatus selected from the group consisting of heating, cooling, ventilating and purifying apparatus or combinations thereof, for treating air in a building.

In a further embodiment, the mixer comprises:

a plurality of first passageways for the first fluid, alternating with a plurality of second passageways for the second fluid, each of said first passageways having an outlet for the first fluid and each of said second passageways having an outlet for the second fluid, each of outlets for the first fluid being contiguous with an outlet for the second fluid;

a plurality of first flaps and second flaps attached to elongate support members, these members permitting the first flaps to pivot from positions wherein the outlets for the first fluid are closed, through intermediate positions, to positions wherein the outlets for the first fluid are open the support members permitting the second flaps to pivot from positions wherein the second fluid outlets are closed, through intermediate positions, to positions wherein the second fluid outlets are open;

said first and second flaps being pivotable simultaneously and in the same direction from positions wherein the first fluid outlets are open and the second fluid outlets are closed to positions wherein the first fluid outlets are closed and the second fluid outlets are open, said first and second flaps being so arranged that in the intermediate positions the first and second fluids, upon exiting from the respective outlets, are diverted towards one another by the first and second flaps.

The invention also provides a process for mixing first and second fluids by passing the first fluid through a first fluid outlet and passing the second fluid through a second fluid outlet, which is contiguous with the first fluid outlet, and mixing the first and second fluids by means of positioning flaps at the first and second fluid outlets so that a stream of first fluid intermingles with a stream of second fluid as the fluids pass the flaps.

In one embodiment, the relative amounts of first and second fluids being mixed is controlled by setting of a first flap which is able to move from a position wherein the first fluid outlet is closed, through intermediate positions, to a position wherein the first fluid outlet is open, a second flap which is able to move from a position wherein the second fluid outlet is closed, through intermediate positions, to a position wherein the second fluid outlet is open, said first and second flaps being connected to move in unison from a position wherein the first fluid outlet is open and the second fluid outlet is closed to a position wherein the first fluid outlet is closed and the second fluid outlet is open.

In another embodiment, the mixing process is carried out in a mixer which has a plurality of pairs of first and second fluid outlets, said first fluid outlets alternating with said second fluid outlets and in which all of the flaps have means to move the flaps in unison.

In yet another embodiment, the first and second fluid outlets are rectangular in cross-section having heights and widths, and have heights H1 and H2 respectively, the ratio of H1 to H2 being from 1:4 to 3:4, said heights being smaller than said widths.

In a further embodiment, the first flap of one pair of first and second outlets and the second flap of a contiguous pair of first and second outlets are fixedly joined, and first fluid is deflected by the second flap, and second fluid is deflected by the first flap so that the first and second fluids are deflected towards one another and commingle.

In yet another embodiment, fresh air is passed from fresh air inlets, through first passageways to the first outlets and return air is passed from return air inlets through second passageways to the second outlets and the return air is distributed across the width of the second outlets by means of at least one perforated diffuser within each second passageway.

In a further embodiment, the relative quantities of first and second fluids being mixed is controlled by means adjusting all of the first and second flaps in unison.

In another embodiment, the first and second fluids are gases of different properties.

In a further embodiment, the first fluid is fresh air and the second fluid is return air.

In yet another embodiment, the first fluid is return air and the second fluid is fresh air.

The present invention is particularly suited to use in heating, cooling, ventilating and air conditioning systems, especially in commercial or industrial buildings.

DETAILED DESCRIPTION OF PREFERRED EMBODIMENTS

Figure 1:
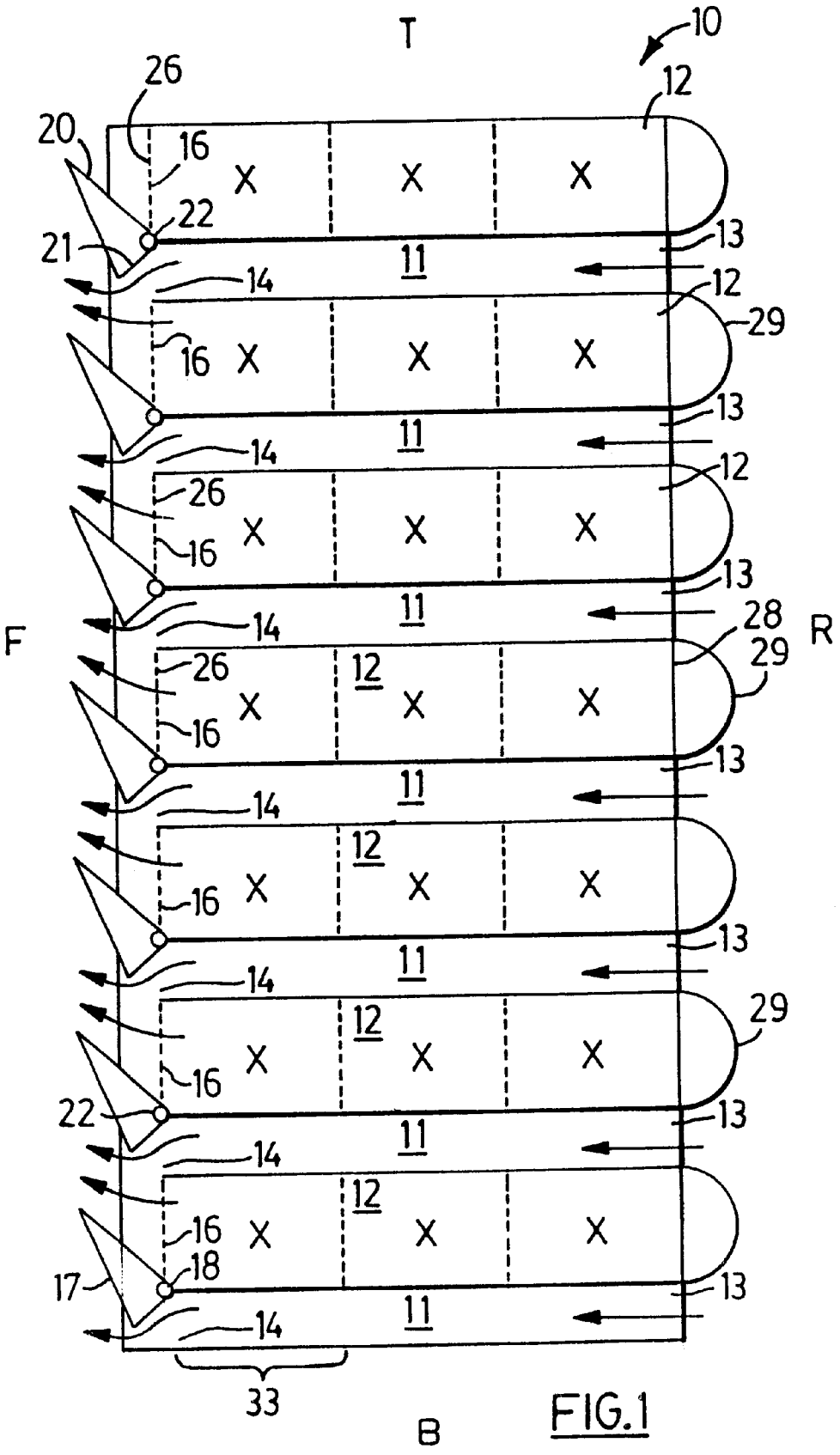
FIG. 1 is a schematic cross-sectional representation of an air mixer constructed in accordance with the invention, seen from the right side of the mixer.
Figure 3:
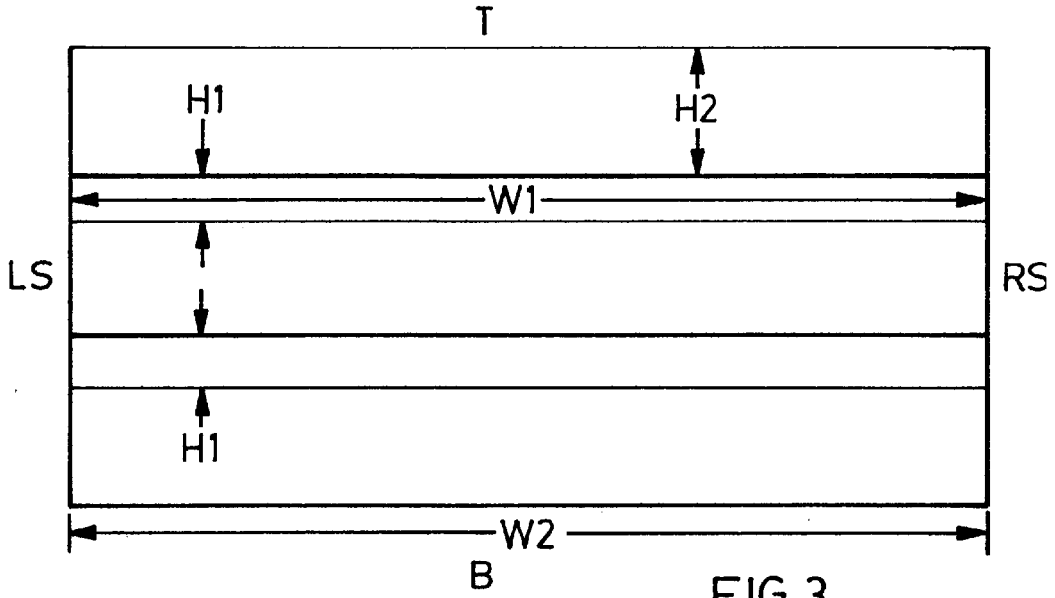
FIG. 3 is a schematic representation of a front view of the air mixer (without flaps) showing return air and fresh air outlets, with the return outlet covered with a perforated sheet.

The invention may be understood by reference to the drawings. For reference purposes, the air mixer is shown having a rear R, front F, top T, bottom B, left side LS and right side RS. FIG. 1 shows an air mixer 10 which has a plurality of fresh air ducts 11 interspersed between a plurality of return air ducts 12. Each of the fresh air ducts 11 has an inlet 13 and an outlet 14. Each of the return air ducts 12 have an inlet (not shown in FIG. 1) and an outlet 16. The fresh air outlets 14 and return air outlets 16 are adjacent one another on the front F of the mixer. As seen best in FIG. 3, the widths W1 and W2 of the fresh air outlets 14 and return air outlets 16 respectively are similar. The height H1 of fresh air outlet 14 is substantially smaller than the height H2 of return air outlet 16. Typically, the ratio of heights H1 to H2 are about 1:2, although it may vary widely, e.g. from about 1:4 to about 3:4.

It will be appreciated that due to the restricted height H1 of the fresh air outlets 14, the fresh air leaves outlets 14 at relatively high velocity, creating so-called jet streams. These jet streams create regions of reduced air pressure, which in turn draw return air through the return air ducts 12 and out of the air outlets 16. This jet stream effect results in enhanced mixing of the two airflows. Typically, the air velocities are in the range of 150 to 610 m/min (500 to 2000 ft./min)

Each pair of fresh air outlet 14 and return outlet 16 has a movable flap combination 17 associated therewith. Movable flap combination 17 is pivotable about a transverse axis 18, which is adjacent floor 19 of return air duct 12. Floor 19 is also the ceiling of fresh air duct 11. Movable flap combination 17 has a large flap 20 which is sufficiently large to cover return outlet 16, and a small flap 21 which is sufficiently large to cover fresh air outlet 14. In the embodiment shown in the drawings, flap combination 17 is fixedly attached to axially rotatable tube 22. Tube 22 is axially rotatable about transverse axis 18. In the embodiment shown in the Figures, large flap 20 and small flap 21 are essentially at right angles to one another. Because the widths of fresh air outlet 14 and return air outlet 16 may be large, large and small flaps 20 and 21 respectively are held with stiffening members 23. Axially rotatable tubes 22 may be rotated manually, e.g. with levers 35 (see FIG. 5) or by other means such as with electric or pneumatic motors or actuators (not shown). It is preferable to gang all of the rotatable tubes 22 together, e.g. by means of connecting rod 36, so that flap combinations 17 rotate in unison. However, it will be recognised that the flaps may be rotated individually or in small groups of flaps, e.g. by means of actuators, levers or the like.

Figure 5:
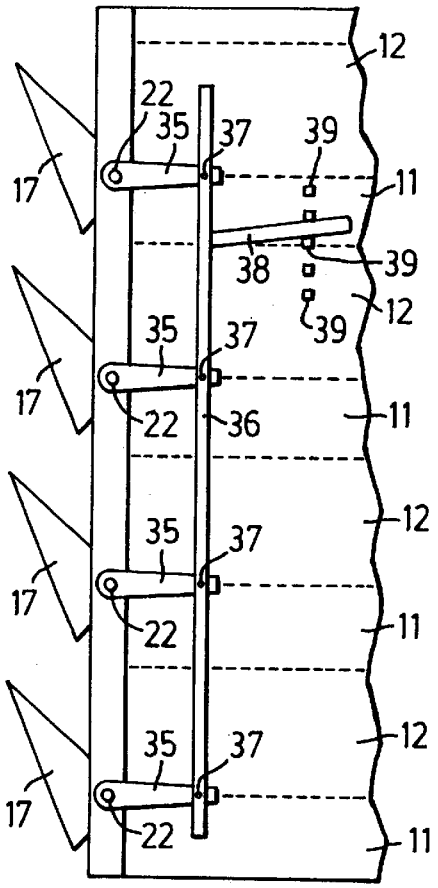
FIG. 5 is a cutaway portion of a side elevation of the mixer of FIG. 1, showing a plurality of flaps ganged together, for moving in unison.

As will be apparent from FIG. 5, levers 35 are fixedly attached to axially rotatable tubes 22 and pivotally attached to connecting rod 36 at pivots 37. Connecting rod 36 has an arm 38 attached thereto. For manually operated systems, arm 38 may be held in a particular position by catches 39. When arm 38 is raised, connecting rod 36 lifts the free ends of levers 35. As rotatable tubes 22 are journalled in bearings or similar, lifting of connecting rod 36 causes rotatable tubes 22 to rotate about the longitudinal axis of the tubes. As tubes 22 are fixedly joined to flap combinations 17, flap combinations 17 are caused to rotate about the longitudinal axes of the tubes. The connecting rod can be kept in any particular position by one of catches 39.

Figure 2:
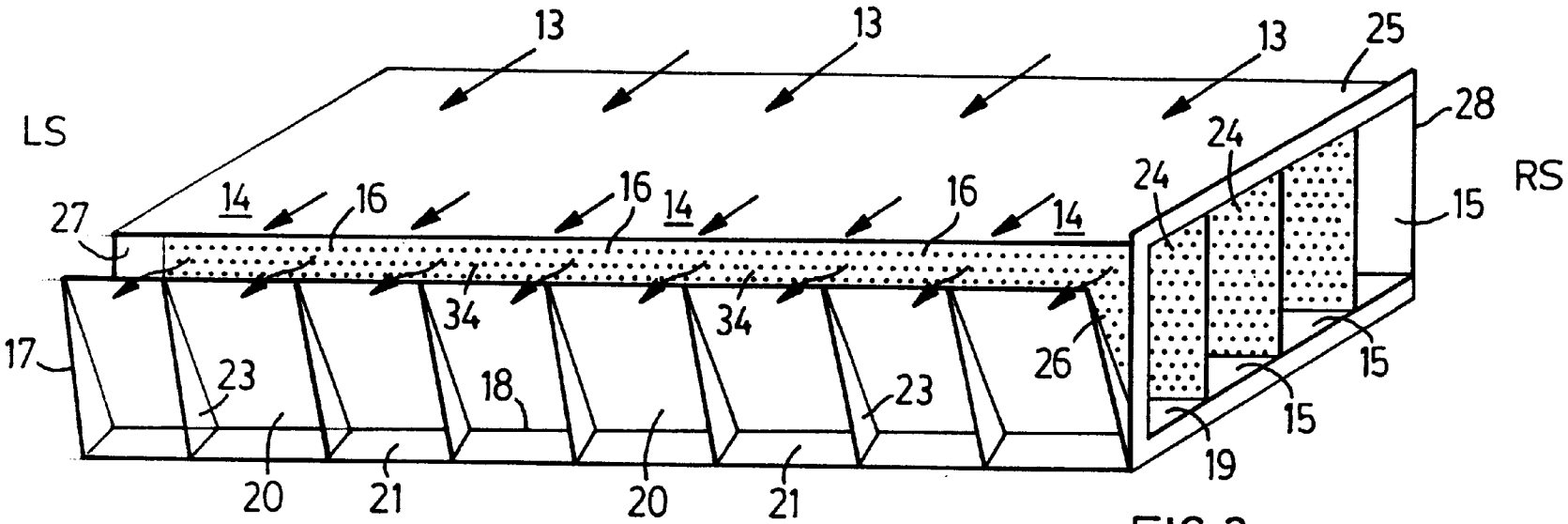
FIG. 2 is a schematic illustration in perspective and taken from a front, down stream end of the air mixer, this Figure showing a second outlet section of the mixer, i.e. a return air duct.

The inlets to the return air ducts 12 are shown at the right side RS of mixer in FIG. 2. Preferably return air ducts 12 have perforated diffusers 24 therein to help distribute the return air across the return air outlet 16. Preferably, perforated diffusers 24 extend from the floor 19 to a ceiling 25 of each return air duct 12. Apart from the top return air duct, the ceiling of a return air duct 12 is also a floor of the adjacent fresh air duct 11. Preferably also there is a perforated diffuser 26 over the return air outlet 16. Apart from functioning as an aid to distribution of air in the return ducts, the perforated diffusers 24 and 26 serve as supports for the ceilings of the return air ducts 12 and fresh air ducts 11. There may also be support dividers (not shown) in the front portion 33 of the return duct 12, as shown at the bottom of FIG. 1.

The left sides LS of return air ducts 12 and fresh air ducts 11 have a wall 27. The rear portions R of return air ducts 12 are closed by a wall 28. Preferably, the portions of the return air ducts 12, which are adjacent to the fresh air inlets 13 (wall 28 in the Figures), have an aerodynamically shaped nose member 29 to assist in guiding air into fresh air inlets 13.

Figure 4A:
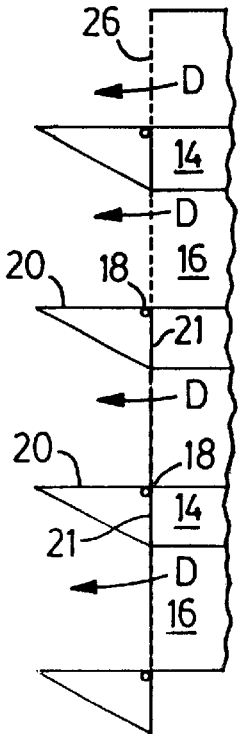
FIG. 4A is a schematic representation of a cross-sectional side view of the mixer, with flaps completely covering the fresh air outlets.
Figure 4B:
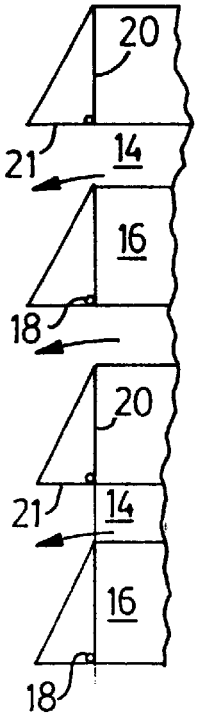
FIG. 4B is a schematic representation of a cross-sectional side view of the mixer, with flaps completely covering the return air outlets.
Figure 4C:
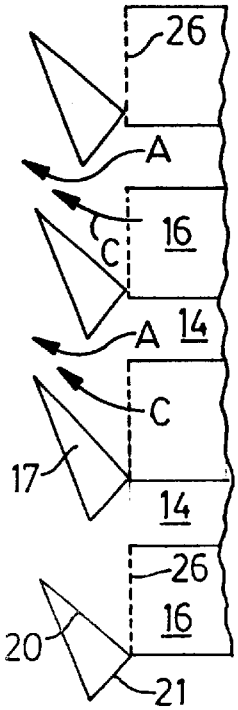
FIG. 4C is a schematic representation of a cross-sectional side view of the mixer, with flaps adjusted to allow flow of air from the fresh air outlets and the return air outlets.

FIG. 4A is a cross-sectional schematic representational side view of the mixer 10, and shows small flaps 21 of flap combinations 17 completely covering the fresh air outlets 14. FIG. 4B is cross-sectional schematic representational side view of the mixer 10, and shows large flaps 20 of flap combinations 17 completely covering the return air outlets 16. FIG. 4C is cross-sectional schematic representational side view of the mixer 10, with flap combinations 17 adjusted to allow flow of air from the fresh air outlets 14 and the return air outlets 16.

Air mixer 10 is intended for installation in an air plenum or chamber (not shown). Fans required for movement of the return air and fresh air are also not shown, but it will understood in the art that a suitable fan unit of known construction can be located downstream of the mixer and that draw the air into the slots of the mixer.

Figure 6A:
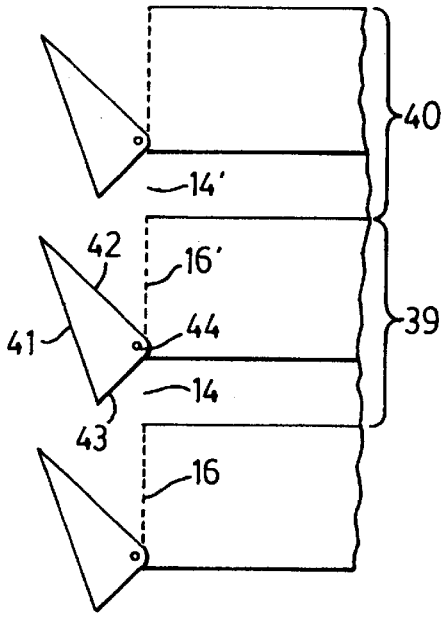
FIG. 6A is schematic side view of pairs of first and second outlets, showing the positioning of first and second flaps.
Figure 6B:
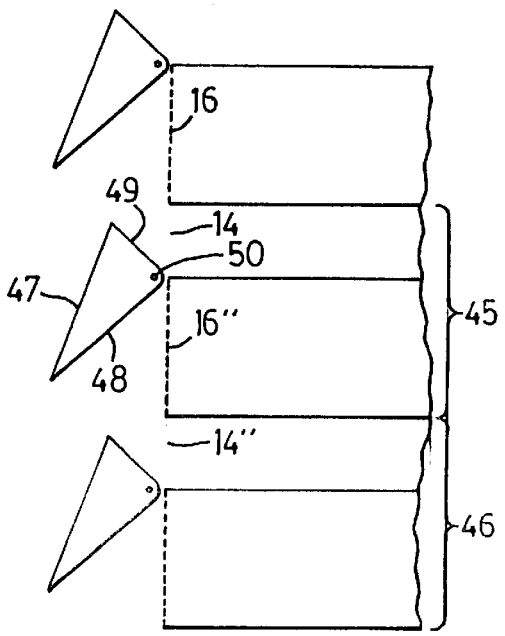
FIG. 6B is a schematic view of pairs of first and second outlets, showing a different positioning of first and second flaps from that shown in FIG. 6A.

FIG. 6A shows a pair 39 of outlets, i.e. a fresh air outlet 14 and a return air outlet 16 contiguous with another pair 40 of outlets, i.e. a fresh air outlet 14' and a return outlet 16'. Flap 41 has a large flap 42 and a small flap 43 which are fixedly joined at 90 degrees to one another. Large flap 42 and small flap 43 can rotate about a common axis 44 (which is the longitudinal axis of a rotatable tube (e.g. tube 22 in FIG. 1). FIG. 6B shows a pair 45 of outlets, i.e. a fresh air outlet 14 and a return air outlet 16 contiguous with another pair 46 of outlets, i.e. a "fresh air outlet 14" and a return outlet 16". Flap 47 has a large flap 48 and a small flap 49 which are fixedly joined at 90 degrees to one another. Large flap 48 and small flap 49 can rotate about a common axis 50, which is the longitudinal axis of a rotatable tube.

In operation, return air is passed into return air duct 12 through inlet 15. Return air is distributed across the width of return air duct 12 as it passes through perforated diffusers 24, e.g. perforated metal panels. The return air then exits from return air duct through outlet 16. Outlet 16 preferably has a perforated metal sheet 16, which serves not only to distribute the exiting air but also to act as a support panel at the outlet. Fresh air may be passed into fresh air duct 11 though inlet 13. The fresh air then exits from air duct 11 through outlet 14, at which point the two air streams are mixed in the plenum.

The relative amounts of return air and fresh air may be controlled by the positioning of flap combinations 17. As shown in FIG. 4A, when flap combination 17 is rotated about axis 18 so that small flap 21 covers outlet 14, no fresh air can pass through fresh air duct 11. However, return air flows freely through each return duct outlet 16 as shown by arrows D.

By manipulating flap combinations 17, e.g. by means of a lever or motor, flap combinations 17 can be rotated about axis 18 so that fresh air outlet 14 is gradually opened, thus allowing fresh air to pass and be deflected by small flap 21, as shown by arrows A in FIG. 4C. Movement of flap combinations 17 to an intermediate position, as shown in FIG. 4C, starts to close off return air outlet 16. Return air is deflected by large flap 20, as shown by arrows C. The fresh air and return air streams meet and mix.

The opposite ends of each tube 22 may are pivotally mounted in suitable bearings (not shown). The ends of the tubes 22 located on one side of the mixer, e.g. on the right side, may be connected to a connecting bar 36 by means of short metal lever members 35. The connecting bar can be moved upwardly or downwardly by H means of a suitable motor, for example an electric motor (not shown). In this way the movement of all the flaps is coordinated so that they can open or close the fresh air outlets 14 or the return air outlets 16 in the same manner and at the same time.

It will be appreciated that the proportion of return air to outdoor air can be varied to a substantial extent by the positioning of the flap combinations 17. By rotating the flaps to the position shown in FIG. 4A, the flow of outdoor air can be cut off entirely so that only return air flows through the plenum onto the heating or cooling coils (for example). By rotating the flap combinations 17 to the position shown in FIG. 4B, where they completely cover the perforated panels 26, the return air flow will be cut off and only fresh outdoor air will pass through the mixer to the heating or cooling coils and the fan unit. Although it is preferable to have all flap combinations 17 connected together, fewer numbers of flaps may be connected, so that there are several gangs of rotatable flaps.

In the normal case, flap combinations 17 will be in a partly open position such as that shown in FIGS. 1 and 4C so that there will be some mixing of return air and fresh air. This is normally desired in order that there will be at least some fresh air introduced into the air handling system. One of the important advantages of this air mixer is of course the fact that it causes a thorough and even mixing of the fresh air, which could be quite cool, and the return air which could be considerably warmer. This is important for the efficient operation of a cooling or heating system.

The flaps shown in the Figures serve a dual purpose. They help mixing of the air within a short distance downstream of the mixer. They also replace the need for dampers at outside air and return air inlets. As such the present invention provides an integration of the mixer and damper functions, creating a plurality of alternating layers of outside air and recirculated air to achieve excellent mixing.

The invention may also be better understood by reference to the following examples:

Example I:

A mixer similar to that shown in FIGS. 1 and 2 was constructed, with 8 outside air passageways and 8 return air passageways. Each of the outside air passageways had a width of 230 cm, a height of 7.6 cm and a depth of 76 cm. Each of the return air passageways had a width of 230 cm, a height of 17.8 cm and a depth of 76 cm. There were outlets from the outside and return air passageways, extending the whole width and height of each passageway, at the front of the mixer. The outlets of the return air passageways had dividers so that the outlet had 8 openings. There was an inlet to each of the outside air passageways extending the whole width and height of the passageways, at the rear of the mixer. There was an inlet to each return air passageway extending the whole depth and height of the passageways, at a side of the mixer. Outside air (fresh air) was drawn, passing through the mixer, by a fan.

In this example, each return air passageway had one perforated diffuser extending from the roof to the floor of the passageway and extending along the width direction of the passageway, i.e from side to side of the mixer. The percentage area of perforations in the diffuser differed across the width of the diffuser, from 32% at one end, 40% in the middle and 50% at the other end. The portion with 50% perforations area was placed adjacent to the inlet so that the portion with 32% perforations area was at the side of the mixer which was distal to the inlet. To obtain the different percentage areas, the perforations at the 50% portion were larger than those in the 40% portion, which in turn were larger than those in the 32% portion.

A test was conducted with the mixer at an outside air ration of 0%, for measuring the velocity of return air at each of the outlets of the return air along the width direction of the passageway, i.e. from side to side of the mixer.

The air velocity in feet per minute, at the return air outlets were measured. The results of the tests are shown in Table I. In the Table, the return passageways are numbered 1–8, starting at the top of the mixer, and the segments of return air outlet are lettered E–L, starting at the inlet side of the return air passageway.

TABLE I

| | E | F | G | H | I | J | K | L |
|---|---|---|---|---|---|---|---|---|
| 1 | 960 | 1000 | 1213 | 1202 | 1223 | 1189 | 1279 | 1058 |
| 2 | 1021 | 1388 | 1322 | 1356 | 1332 | 1231 | 1219 | 1153 |
| 3 | 1037 | 1352 | 1213 | 1372 | 1377 | 1284 | 1263 | 1115 |
| 4 | 1022 | 1252 | 1345 | 1384 | 1334 | 1219 | 1213 | 1225 |
| 5 | 1104 | 1354 | 1329 | 1376 | 1356 | 1372 | 1234 | 1213 |
| 6 | 962 | 1356 | 1337 | 1342 | 1398 | 1361 | 1314 | 1162 |
| 7 | 1049 | 1137 | 1229 | 1241 | 1339 | 1361 | 1328 | 1115 |
| 8 | 923 | 1213 | 1156 | 1143 | 1321 | 1231 | 1198 | 1032 |

The results show that the perforated diffuser provides a uniform return air distribution at the return air outlet along the width direction of the return air passageway, i.e. from side to side of the mixer. This is important for good mixing effectiveness of two airstreams in the plenum.

Further experiments were conducted to determine the mixing effectiveness of the mixer. Mixing effectiveness was determined by measuring the temperatures of the outside air, the return air and temperatures at locations downstream of the mixer. The ratio of volumes of outside air to the total of return air and outside air was kept constant at 30%. Temperatures were measured using a computer data system with a Macintosh (trade mark) computer, MacADIOS (trade mark) analogue to digital converter and calibrated LM35CAH semiconductor temperature sensors.

Mixing effectiveness was calculated from:

$$1-(T_{max}-T_{min})/(T_{RA}-T_{OA})$$

wherein $(T_{max}-T_{min})$ is the difference of maximum and minimum temperatures at a particular position downstream of the mixer outlets. $T_{RA}$ is the temperature of the return air and $T_{RA}$ is the temperature of the outside air.

The results are shown in Table II for the mixing effectiveness as measured at different distances, in inches, downstream from the outlets from the mixer.

TABLE II

| Distance (inches) | 6 | 18 | 30 | 42 |
|---|---|---|---|---|
| Mixing effectiveness | 0.62 | 0.75 | 0.83 | 0.89 |

The results show that the mixer of this example gives high mixing performance.

What is claimed is:

1. A mixer for first and second fluids, comprising:

a plurality of first outlets for the first fluid and a plurality of second outlets for the second fluid with said first outlets alternating with said second outlets and each first outlet being contiguous with a respective one of said second outlets;

a first flap for each of said first outlets, each first flap being pivotable from one position wherein its respective first outlet is closed, through intermediate positions, to another position wherein its respective first outlet is open;

a second flap for each of said second outlets, each second flap being pivotable from an initial position wherein its respective second outlet is closed, through intermediate positions, to a further position wherein its respective second outlet is open;

wherein each first flap is paired with one of the second flaps and is rigidly connected thereto so that each pair of first and second flaps moves in unison and in the same direction of rotation, and wherein, during use of said mixer, said first and second flaps are pivotable in unison from said another position of the first flaps and said initial position of the second flaps to said one position of the first flaps and said further position of the second flaps, said first and second flaps of each pair being so arranged relative to one another that in the intermediate positions, the first and second fluids, upon exiting from the respective outlets, are diverted towards one another by said first and second flaps.

2. A mixer according to claim 1 wherein the first and second outlets are rectangular in cross-section, with heights and widths, and each first outlet has a substantially smaller cross-sectional area than that of each second outlet.

3. A mixer according to claim 2 wherein the first and second outlets each have heights H1 and H2 respectively, the ratio of H1 to H2 being from 1:4 to 3:4, said heights being smaller than said widths.

4. A mixer according to claim 1 wherein the first and second flaps of each connected pair are substantially at right angles to one another.

5. A mixer according to claim 4 wherein each connected pair of first and second flaps is pivotable about an axis which is adjacent to a juncture of adjacent first and second outlets.

6. A mixer according to claim 4 wherein the mixer has a fresh air inlet connected to the first outlets and a return air inlet connected to the second outlets and there is at least one perforated diffuser in each of a plurality of passageways from the return air inlet to the second outlets for distributing the return air across the width of the second outlets.

7. A mixer according to claim 6 wherein the percentage area of the perforated diffuse which comprises perforations varies across the width of the diffuser.

8. A mixer according to claim 7 wherein there is only one perforated diffuser in each passageway from the return air inlet to a respective one of the second outlets for distributing the return air.

9. A mixer according to claim 8 wherein said percentage area of the perforated diffuser decreases from a section of said diffuser adjacent said return air inlet to an opposite end section of said diffuser which is distal to said return air inlet.

10. A mixer according to claim 9 wherein said percentage area of the perforated diffuser is an average of at least 40 per cent taken across the width of the diffuser.

11. A process for mixing first and second fluids comprising:

providing a mixer which has a plurality of pairs of first and second fluid outlets, said first outlets alternating with said second fluid outlets;

passing the first fluid through said first fluid outlets and passing the second fluid through the second fluid outlets each of which is adjacent to a respective one of the first fluid outlets;

providing pairs of pivotable first and second flaps at said first and second fluid outlets with the first flap of each pair being rigidly connected to the second flap of the pair, the flaps of each pair being pivotable in unison and in the same direction from a first position where the first fluid outlets are open and the second fluid outlets are closed to a second position where the first fluid outlets are closed and the second fluid outlets are open; and mixing the first and second fluids by means of said pairs of flaps so that streams of said first fluid intermingle with streams of said second fluid as the fluids pass said first and second flaps.

12. A process according to claim 11 wherein the first and second fluid outlets are rectangular in cross-section having widths, and having heights H1 and H2 respectively, the ratio of H1 to H2 being from 1:4 to 3:4, said heights being smaller than said widths.

13. A process according to claim 12 wherein the first and second fluids are deflected by both the first and second flaps towards one another and commingle.

14. A process according to claim 13 wherein the relative quantities of first and second fluids being mixed is controlled by means adjusting all of the first and second flaps in unison.

15. A process according to claim 11 wherein the first and second fluids are gases of different properties.

16. A process according to claim 15 wherein the first fluid is fresh air and the second fluid is return air.

17. A process according to claim 16 wherein the first and second fluid outlets are rectangular in cross-section having widths, and having heights H1 and H2 respectively, the ratio of H1 to H2 being from 1:4 to 3:4, said heights being smaller than said widths.

18. A process according to claim 17 wherein said fresh air is passed from a fresh air inlet, through first passageways to the first fluid outlets and said return air is passed from a return air inlet through second passageways to the second fluid outlets and the return air is distributed across the width of the second outlets by means of at least one perforated diffuser within each second passageway.

19. A process according to claim 17 wherein said fresh air is passed from a fresh air inlet, through first passageways to the first fluid outlets said and return air is passed from a return air inlet through second passageways to the second fluid outlets and the fresh air is distributed across the width of the first fluid outlets by means of at least one perforated diffuser within each first passageway.

* * * * *

UNITED STATES PATENT AND TRADEMARK OFFICE

CERTIFICATE OF CORRECTION

PATENT NO. : 6,241,601 B1
DATED : June 5, 2001
INVENTOR(S) : Han et al.

It is certified that error appears in the above-identified patent and that said Letters Patent is hereby corrected as shown below:

Column 9, claim 7,
Line 11, delete "diffuse" and substitute therefor -- diffuser --.

Column 10, claim 19,
Line 34, delete "said and" and substitute therefor -- and said --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*